US008936140B2

(12) United States Patent
Herold

(10) Patent No.: US 8,936,140 B2
(45) Date of Patent: Jan. 20, 2015

(54) SELF-STABILIZED ROLLABLE LUGGAGE ASSEMBLY AND CORRESPONDING ASSEMBLY METHOD

(76) Inventor: Jeffrey Herold, Huntington Beach, CA (US)

( * ) Notice: Subject to any disclaimer, the term of this patent is extended or adjusted under 35 U.S.C. 154(b) by 409 days.

(21) Appl. No.: 12/348,857

(22) Filed: Jan. 5, 2009

(65) Prior Publication Data

US 2010/0170761 A1 Jul. 8, 2010

(51) Int. Cl.
*A45C 5/14* (2006.01)
*A45C 7/00* (2006.01)
*A45C 13/10* (2006.01)

(52) U.S. Cl.
CPC ..... *A45C 5/14* (2013.01); *A45C 7/0045* (2013.01); *A45C 13/10* (2013.01)
USPC ..... 190/108; 190/15.1; 190/18 A

(58) Field of Classification Search
USPC ..... 190/15.2, 18 A, 39, 102, 108, 115, 117, 190/15.1; 150/111; 383/37; 280/47.17
See application file for complete search history.

(56) References Cited

U.S. PATENT DOCUMENTS

| | | | | | |
|---|---|---|---|---|---|
| 922,567 | A | * | 5/1909 | Cosgrove | 190/108 |
| 3,319,744 | A | * | 5/1967 | Smith | 190/108 |
| 4,424,841 | A | * | 1/1984 | Smith | 224/240 |
| 4,743,038 | A | * | 5/1988 | Myers et al. | 280/40 |
| 5,050,713 | A | * | 9/1991 | Lee | 190/108 |
| 5,501,308 | A | | 3/1996 | King | |
| 5,547,052 | A | * | 8/1996 | Latshaw | 190/108 |
| 5,660,476 | A | * | 8/1997 | DeCoster | 383/29 |
| 5,671,832 | A | * | 9/1997 | London et al. | 190/108 |
| 5,699,886 | A | * | 12/1997 | Latshaw | 190/108 |
| 5,713,439 | A | * | 2/1998 | Zionts et al. | 190/102 |
| 5,788,032 | A | * | 8/1998 | Krulik | 190/108 |
| 5,829,559 | A | | 11/1998 | Nordstrom et al. | |
| 5,890,571 | A | * | 4/1999 | Sadow | 190/102 |
| 5,988,334 | A | * | 11/1999 | Caruso | 190/18 A |
| 6,098,769 | A | * | 8/2000 | Yen | 190/108 |
| 6,230,771 | B1 | * | 5/2001 | Hellenbrand | 150/111 |
| 7,246,802 | B2 | * | 7/2007 | Yeung | 280/1.5 |
| 7,322,477 | B2 | * | 1/2008 | Schweitz | 206/579 |
| 2003/0038008 | A1 | * | 2/2003 | Han | 190/115 |
| 2005/0072643 | A1 | * | 4/2005 | Gormick et al. | 190/111 |
| 2005/0077136 | A1 | * | 4/2005 | Brannin | 190/108 |
| 2006/0022006 | A1 | * | 2/2006 | Cruise | 224/572 |
| 2006/0086583 | A1 | * | 4/2006 | Hoberman et al. | 190/108 |
| 2006/0102672 | A1 | * | 5/2006 | Godshaw | 224/572 |
| 2006/0266603 | A1 | * | 11/2006 | Godshaw et al. | 190/108 |

(Continued)

FOREIGN PATENT DOCUMENTS

| | | | |
|---|---|---|---|
| JP | 03-036006 | U9 | 1/1997 |
| WO | WO9639891 | A1 | 12/1996 |

OTHER PUBLICATIONS

Press Release dated Jun. 11, 2007 entitled "Create Your Own Smooth Rolling Luggage Train With Club Glove".

(Continued)

*Primary Examiner* — Sue A Weaver
(74) *Attorney, Agent, or Firm* — Donn K. Harms

(57) ABSTRACT

A luggage assembly includes a first piece of luggage and a second piece of luggage. An attachment member is affixed to the second piece of luggage. The attachment member couples the second piece of luggage to the first piece of luggage so that the first and second pieces of luggage are self-stabilized while upright and inclined, and while in motion and while stationary.

14 Claims, 11 Drawing Sheets

(56) References Cited

U.S. PATENT DOCUMENTS

| | | | | |
|---|---|---|---|---|
| 2007/0089953 | A1* | 4/2007 | Kohn | 190/102 |
| 2007/0164067 | A1* | 7/2007 | Wright | 224/401 |
| 2008/0308369 | A1* | 12/2008 | Louis | 190/108 |
| 2009/0139813 | A1* | 6/2009 | Francis | 190/18 A |
| 2010/0059323 | A1* | 3/2010 | Marji | 190/18 A |

OTHER PUBLICATIONS

International Search Report and Written Opinion dated Aug. 13, 2010.

* cited by examiner

SELF-STABILIZED ROLLABLE LUGGAGE ASSEMBLY AND CORRESPONDING ASSEMBLY METHOD

BACKGROUND

Some conventional pieces of luggage, such as carry-on bags and rolling duffel bags, may have rollers on the bottom to make the bags easier for travelers to transport. However, travelers often need to transport two or more wheeled pieces of luggage simultaneously. If a traveler needs to transport two wheeled pieces of luggage, both hands are typically required. Consequently, while transporting two or more large, heavy pieces of luggage, the traveler may find it difficult or impossible to do other things, such as answering a cellular telephone call, retrieving cash or keys from a pocket or purse, holding the hand of a small child, etc.

Furthermore, in many situations, travelers find it difficult to maneuver multiple pieces of luggage simultaneously. For instance, it can be difficult to safely transport two large pieces up or down a step or escalator, or to transport both pieces through a narrow opening. Such maneuvers may be particularly difficult when the traveler is small and one or both of the pieces of luggage are large and heavy. When more than two pieces need to be transported, these kinds of difficulties may be multiplied.

BRIEF DESCRIPTION OF THE DRAWINGS

Features and advantages of the present invention will become apparent from the appended claims, the following detailed description of one or more example embodiments, and the corresponding figures, in which:

DETAILED DESCRIPTION

Figure 1:
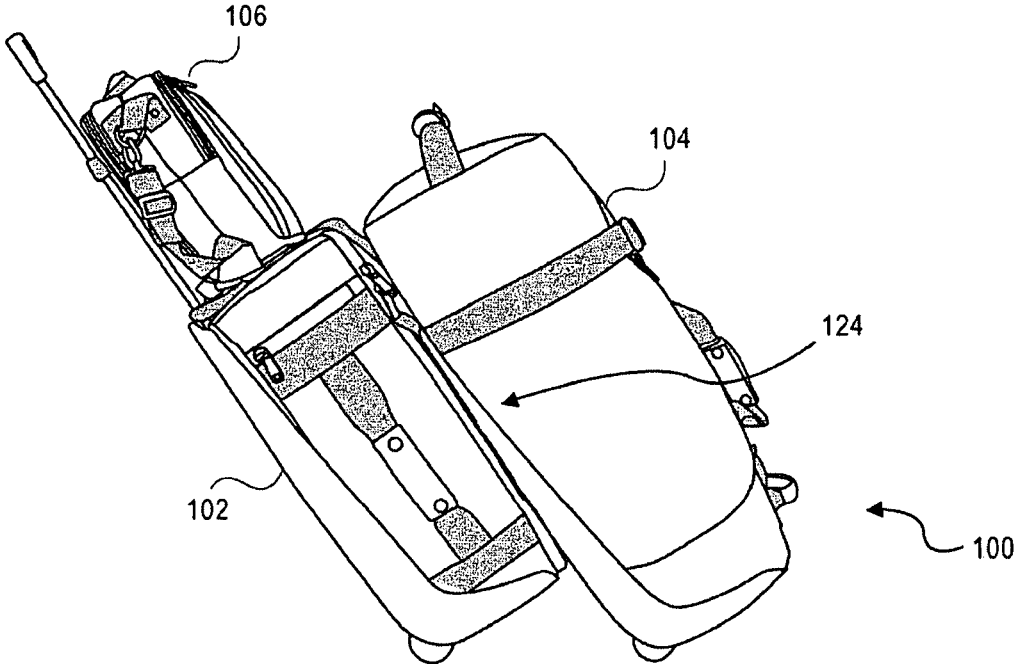
FIG. 1 shows an embodiment of a self-stabilized rollable luggage assembly.

FIG. 1 depicts an example embodiment of such a luggage assembly 100 including carry-on bag 102 connected to a trailing bag 104, and a third bag 106. Moreover, the bags 102, 104, 106 are connected in a way that allows a majority of the weight of the assembly 100 to rest on the wheels of carry-on bag 102 and trailing bag 104. Assembly 100 is self-stabilized when in motion and when stationary, and in particular, a traveler does not need to hold handle 236 for the assembly 100 to remain upright or in an inclined position whether or not assembly 100 is in motion. These and other characteristics of luggage assembly 100 provide for excellent stability and maneuverability. Additional details concerning the components and steps used for creating a rollable luggage assembly 100, as well as various operating characteristics of luggage assembly 100, are provided below.

Figure 2:
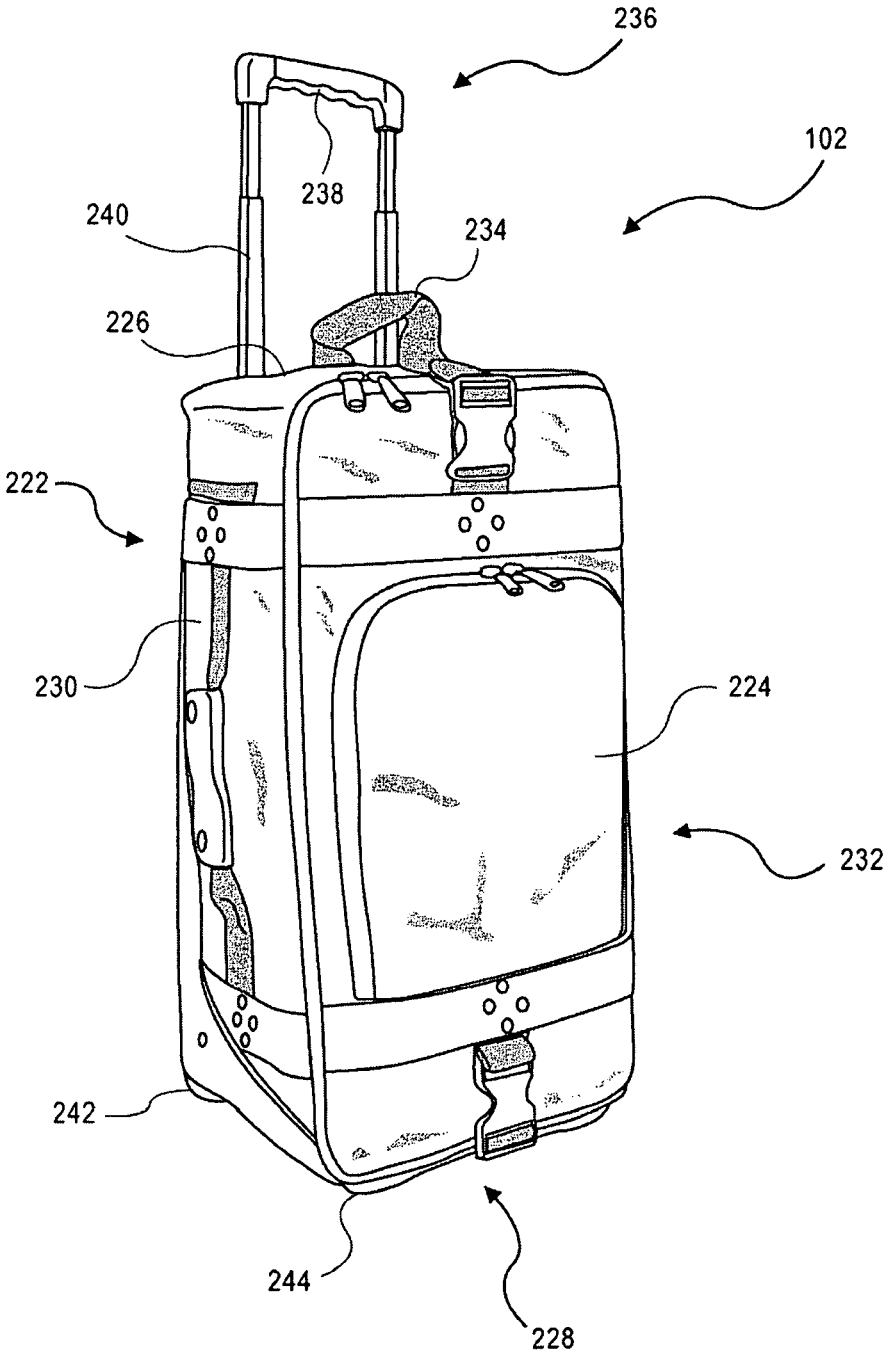
FIG. 2 depicts a perspective view of a piece of luggage referred to as a carry-on bag.

FIG. 2 depicts a perspective view of an embodiment of a piece of luggage referred to as a carry-on bag 102. As illustrated, carry-on bag 102 has a front 224, a back 222, a top 226, a bottom 228, a left side 230, and a right side 232. As described in greater detail below, in some embodiments, carry-on bag 102 serves as the foundation for an assembly of bags that can easily be transported, maneuvered, and parked.

For purposes of this disclosure, carry-on bag 102 may be referred to as a first bag, a base bag, or a leading bag 102. In one embodiment, the dimensions of first bag 102 are approximately 23 inches high, 12 inches wide, and 10 inches deep. In other embodiments, other types and/or sizes of bags may be used as the first bag or base bag.

In the embodiment of FIG. 2, the top of first bag 102 features a soft handle 234. Left side 230 can also features a soft handle. First bag 102 also features a substantially rigid, yet extendable handle 236 that includes two extendable, rigid upright members 240, and a substantially rigid grip member 238 that spans the top of upright members 240. In the embodiment of FIG. 1, handle 236 is situated at the back of bag 102, and is centered longitudinally between the left and right sides.

First bag 102 can also have a pair of wheels 242, with one wheel situated at the back left corner of the bottom of the bag 102, and the other wheel situated at the back right corner of the bottom of the bag 102. One or more feet 244 may also be provided at or near the front edge of the bottom of first bag 102, to provide stability and prevent movement when first bag 102 is parked in an upright position with the weight resting on feet 244 and wheels 242.

Figure 3:
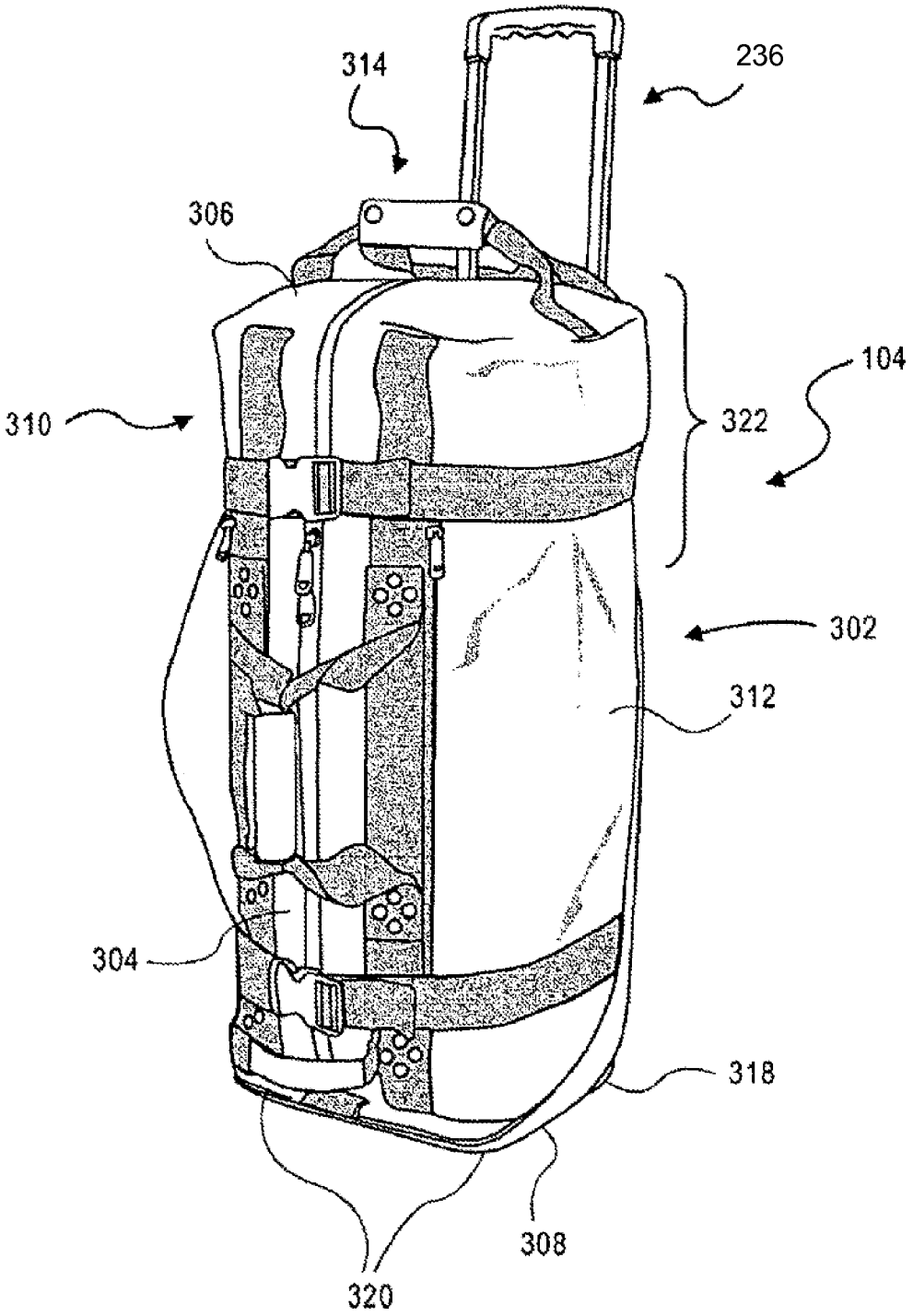
FIG. 3 shows a perspective view of a piece of luggage referred to as a rolling duffel bag.

FIG. 3 depicts a perspective view of an embodiment of a piece of luggage known as rolling duffel bag 104. As illustrated, rolling duffel bag 104 has a front 304, a back 302, a top 306, a bottom 308, a left side 310, and a right side 312.

In some embodiments, rolling duffel bag 104 is connected to first bag 102 to create a luggage assembly 100 that can easily be transported, maneuvered, and parked. Accordingly, for purposes of this disclosure, rolling duffel bag 104 may be referred to as a second bag or a trailing bag 104. In at least one embodiment, the trailing bag 104 is larger than the leading bag. In one embodiment, the dimensions of second bag 104 are approximately 28.5 inches high, 13.5 inches wide, and 11.5 inches deep. In another embodiment, the dimensions of the second bag are approximately 33 inches high, 16 inches wide, and 13 inches deep. In another embodiment, the second bag may be greater than 47 inches high. In other embodiments, other types and/or sizes of bags may be used as the second bag or trailing bag 104. For example, the trailing bag 104 may be the same size as, or smaller than, the leading bag 102, with attachment means 604 (FIG. 6) dimensioned accordingly (e.g., a longer attachment strap) to provide a suitable weight distribution to stabilize the bags 102, 104.

In the embodiment of FIG. 3, the top of second bag 104 features a soft handle 314. Second bag 104 may also feature a rigid, extendable handle 236, along with a pair of wheels 318 at the back corners of the bottom of the bag, and one or more feet 320 at or near the front edge of the bottom. Feet 320 may provide stability and prevent movement when second bag 104 is parked in an upright position on feet 320 and wheels 318.

Figure 4:
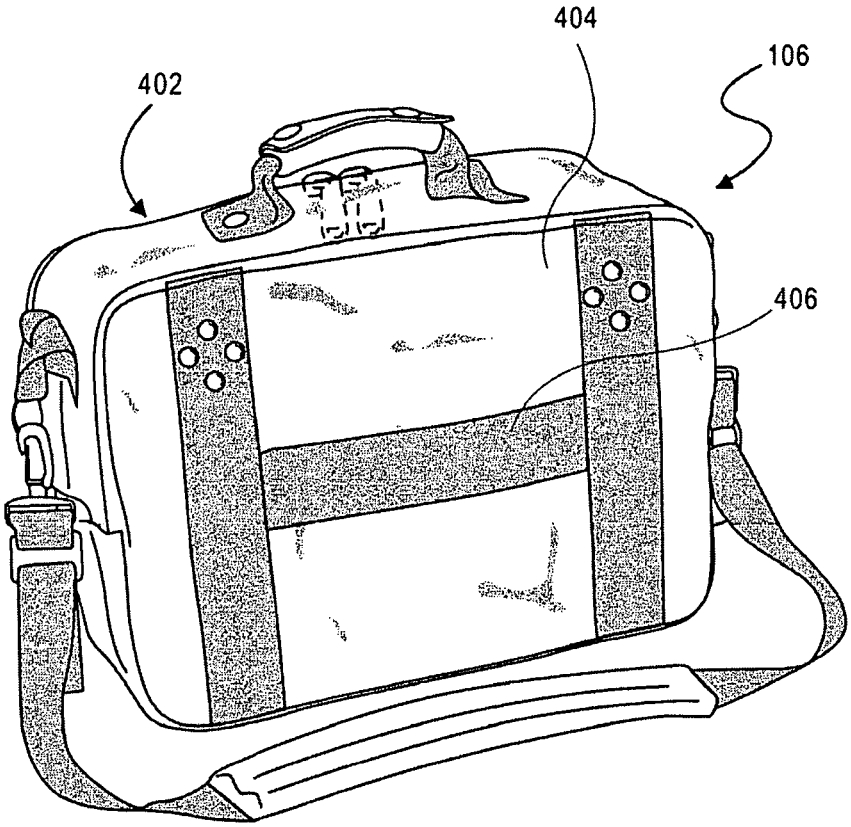
FIG. 4 depicts a perspective view of a piece of luggage referred to as a shoulder bag.

FIG. 4 depicts a perspective view of an embodiment of piece of luggage known as shoulder bag 106. As illustrated, shoulder bag 106 has a back 402, a front 404, and a strap 406. As described in greater detail below, in one embodiment, shoulder bag 106 may be connected to first bag 102 along with second bag 104 to create an assembly of bags that can easily be transported, maneuvered, and parked. Accordingly, for purposes of this disclosure, shoulder bag 106 may be referred to as a top bag or a third bag 106.

In the embodiment of FIG. 4, strap 406 is dimensioned to snugly receive handle 236. Thus, strap 406 may be slid down handle 236 until third bag 106 rests on top of first bag 102, and strap 406 will thereafter prevent top bag 106 from being dislodged. In other embodiments, other types and/or sizes of bags may be used as the third bag 106 (e.g., a laptop bag, a purse, a carry-all bag, a gear bag). Typically the third bag 106 can be sized to meet airline requirements for carry-on bags. For instance, the third bag 106 could be small enough to fit under a typical airline seat. In other embodiments, the third bag 106 may be omitted.

FIGS. 5-8 depict side views of the components depicted in FIGS. 2-4. In addition, FIGS. 5-8 illustrate an embodiment of a method for creating luggage assembly 100 (FIG. 1).

Figure 5:
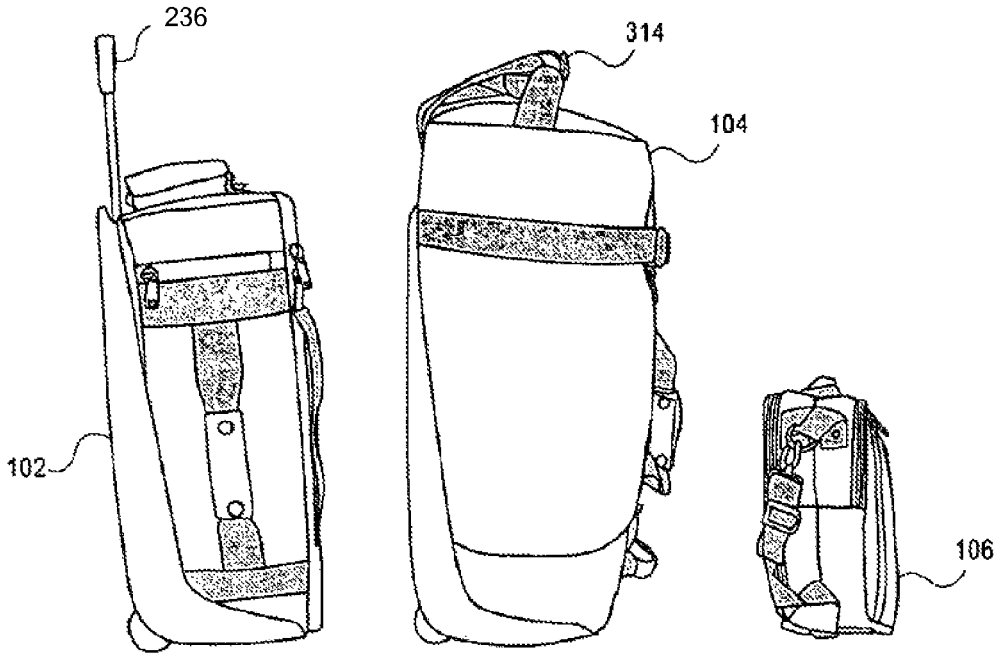
FIGS. 5-8 shows side views of the components depicted in FIGS. 2-4, illustrating a method for creating a luggage assembly or luggage train, according to an example embodiment of the present intention.

FIG. 5 depicts first bag 102, second bag 104, and third bag 106 resting on the floor, each in an upright position, as they might be situated, for instance, after a traveler has retrieved second bag 104 from a baggage carousel. The process for attaching the bags together in a manner to create a stable luggage assembly 100 may begin with the bags in this position. The traveler may then separate handle 314 into two separate members.

Figure 6:
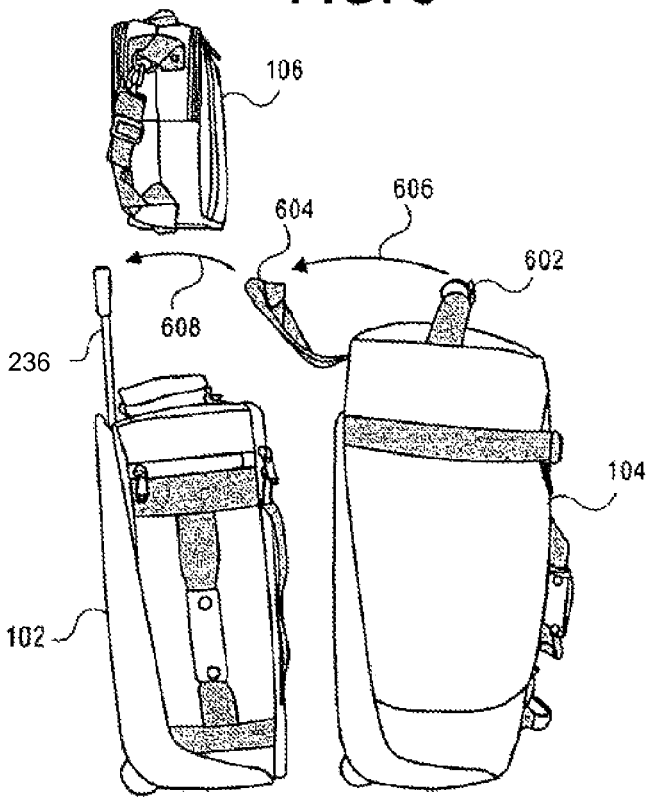

As shown in FIG. 6, handle 314 may include a main handle strap 602 and a reinforcement handle strap 604. A sleeve with snaps, or any other temporary connection means, may be used to keep main handle strap 602 and reinforcement handle strap 604 connected when second bag 104 is being used alone. When desired, however, the traveler may release the temporary connection means, to allow the traveler to separate reinforcement handle strap 604 from main handle strap 602, as shown by arrow 606 in FIG. 6.

In one embodiment, two ends of main handle strap 602 are connected to the top of second bag 104, at two points at or near the left and right edges of the top 306 of bag 104, while two ends of reinforcement handle strap 604 are connected to the upper portion 322 (e.g., the upper third) of the back of second bag 104. For instance, the two ends of reinforcement handle strap 604 may be connected at two points at or near the top edge of the back 302. In one embodiment, the two attachment points for reinforcement handle strap 604 are approximately equal distances from the longitudinal center of second bag 104, and the two attachment points are situated at least as far apart from each other as are the upright members 240 of handle 236 of first bag 102. Other embodiments may use other configurations of uprights, handles, and/or straps.

Once the traveler has separated reinforcement handle strap 604 from main handle strap 602, the traveler lifts reinforcement handle strap 604 over grip 238 of handle 236, as shown by arrow 608. Extendable handle 236 may be retracted to make this operation easier.

Figure 7:
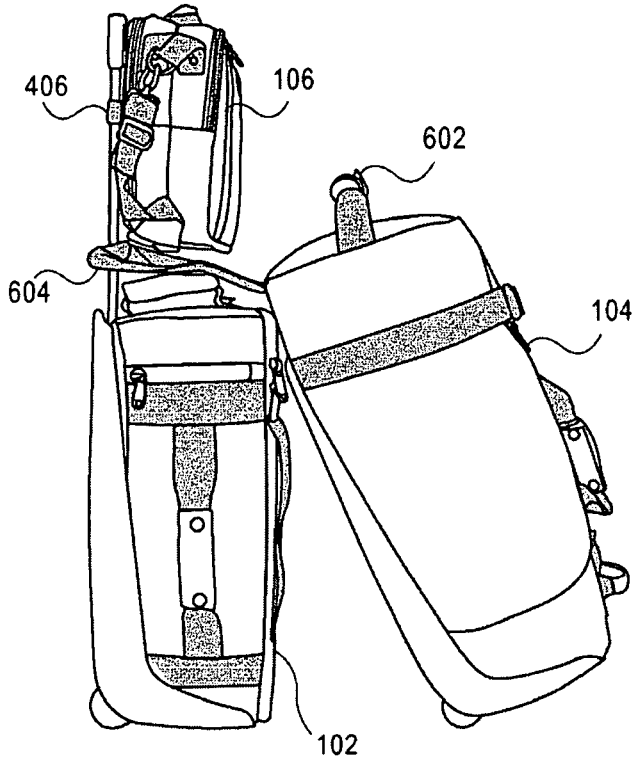

As shown in FIG. 7, the traveler then slides reinforcement handle strap 604 down handle 236, and/or extends handle 236 up through reinforcement handle strap 604, to couple second bag 104 to first bag 102. Accordingly, reinforcement handle strap 604 and handle 236 may serve as, and may be referred to as, attachment members. Similarly, reinforcement handle strap 604 may also be referred to as an attachment strap 604.

Figure 9:
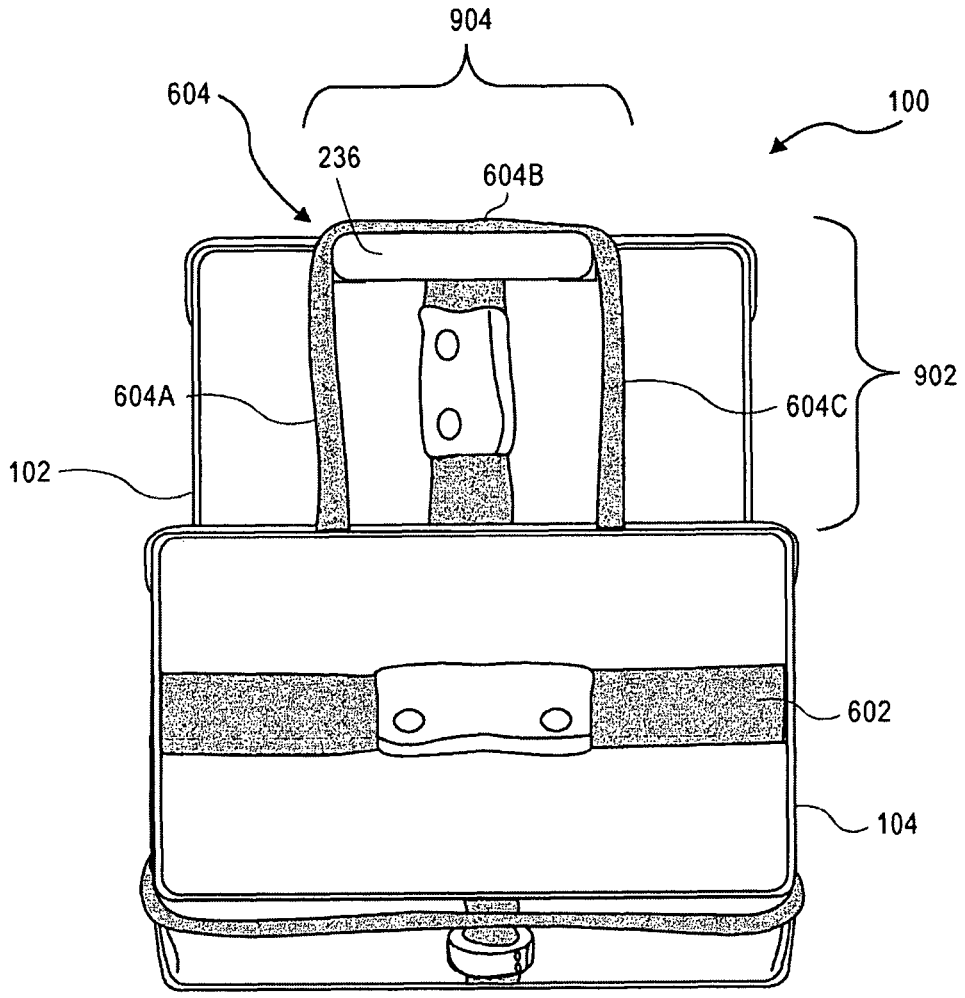
FIG. 9 depicts a top view of the carry-on bag and the rolling duffel bag from FIG. 7.

FIG. 9 depicts a top view of the configuration of first bag 102 and second bag 104 shown in FIG. 7 with the second bag 104 attached to the first bag 102, but without third bag 10 As illustrated, once the traveler has attached second bag 104 to first bag 102 with reinforcement handle strap 604, reinforcement handle strap 604 may have three segments, namely, a first segment 604A and a third segment 604C, each of which extends from second bag 104 around handle 236, and an intermediate second segment 604B, which spans handle 236. In one embodiment, first segment 604A and third segment 604C are approximately the same length 902, and that length 902 is approximately twice the length 904 of the segment that spans handle 236. For instance, segments 604A and 604C may be approximately 10 inches long, and segment 604B may be approximately six inches long. The distance between the attachment points on second bag 104 for segments 604A and 604C may also be approximately six inches 904 The relatively wide intermediate segment, in conjunction with the relatively wide attachment points on second bag 104, may provide increased stability for the luggage assembly 100 by helping to prevent the left or right side of second bag 104 from lifting away from first bag 102. Other dimensions and/or proportions may be used in other embodiments. For instance, the rigid handle 236 on the leading bag 102 could be wider than six inches or less than six inches (e.g., a single post), and the attachment strap could be longer or shorter, correspondingly. A rollable luggage assembly 100 may thus use an attachment strap 604 that is proportionate in length to the distance from the trailing bag 104 to and around the handle 236 to prevent the trailing bag 104 from sliding too far down the leading bag 102.

Referring again to FIG. 7, the traveler may also attach third bag 106 to the assembly 100 by sliding strap 406 down handle 236 to rest third bag 106 on top of first bag 102 and reinforcement handle strap 604. The added weight of third bag 106 on reinforcement handle strap 604 may provide increased stability for luggage assembly 100. The added weight of third bag 106 may also contribute to the overall stability of luggage assembly 100, depending on the weight and angle of the other bags. For instance, if the trailing bag 104 was very heavy and the leading bag 102 was very light, a third bag 106 on top of the leading bag 102 could provide a beneficial force downward in front of the wheels 242 of the first bag 102 to prevent the first bag 102 from reverting to the upright position.

Furthermore, as indicated above, many different kinds of objects could be used as the third bag 106. For instance, a box or package may be placed on top of first bag 102 to serve as the third bag 106, and the rollable luggage assembly 100 may also serve as a self-stabilized dolly for transporting that box or package. Third bag 106 may or may not include strap 406.

When handle 236 has been extended up through reinforcement handle strap 604, the assembly may take on substantially the configuration shown in FIG. 7, with first bag 102 in an upright position and second bag 104 leaning against first bag 102. In this configuration, most of the weight of second bag 104 may rest behind wheels 318. The force of gravity may therefore pull reinforcement handle strap 604 firmly against the front of upright members 240 and the top of first bag 102. Reinforcement handle strap 604 is configured to retain second bag 104 in contact with at least a portion of first bag 102, and may prevent second bag 104 from sliding down or moving away from the front of first bag 102 while luggage assembly 100 is in motion. In one embodiment, reinforcement handle strap 604 keeps the top back edge of second bag 104 substantially adjacent to the top back edge of first bag 102. In other embodiments, the attachment member may allow the second bag 104 to slide a short distance further down the back of the first bag 102. However, it is generally preferable to keep to top of the second bag 104 within a certain distance, such as, for example, approximately two inches of the top of the first bag 102, to provide weight distribution advantages such as those described below.

Referring again to FIG. 8, luggage assembly 100 is depicted in an inclined configuration. Specifically, (a) reinforcement handle strap 604 of second bag 104 is wrapped around handle 236 of first bag 102, (b) third bag 106 is resting on top of first bag 102 and reinforcement handle strap 604, with strap 406 receiving handle 236, (c) both first bag 102 and second bag 104 are inclined at an angle on their wheels 242, 318 with the feet 244, 320 elevated from the floor, and (d) at least a portion of the back of second bag 104 is in contact with at least a portion of the front of first bag 102. In embodiments that do not include third bag 106, the assembly 100 may be considered fully assembled when in the preceding configuration, but without third bag 106.

Reinforcement handle strap 604 is dimensioned to engage handle 236 when second bag 104 is situated next to first bag 102. Reinforcement handle strap 604 is typically flexible but substantially inelastic, but strap 604 can also have some elasticity. Consequently, when first bag 102 is tilted forward from an upright position into the inclined position shown in FIG. 8, reinforcement handle strap 604 substantially prevents second bag 104 from sliding down the front of first bag 102 or moving away from first bag 102 while assembly 100 is in motion and stationary. For instance, the relative positions of the tops of first bag 102 and second bag 104 may change by less than five percent of the height of first bag 102 (e.g., approximately one inch) in the embodiment of FIG. 8. In other embodiments, depending on the size and weight of the trailing bag 104, the attachment means 604 may provide for a larger or smaller change in position to maintain balance.

Figure 8:
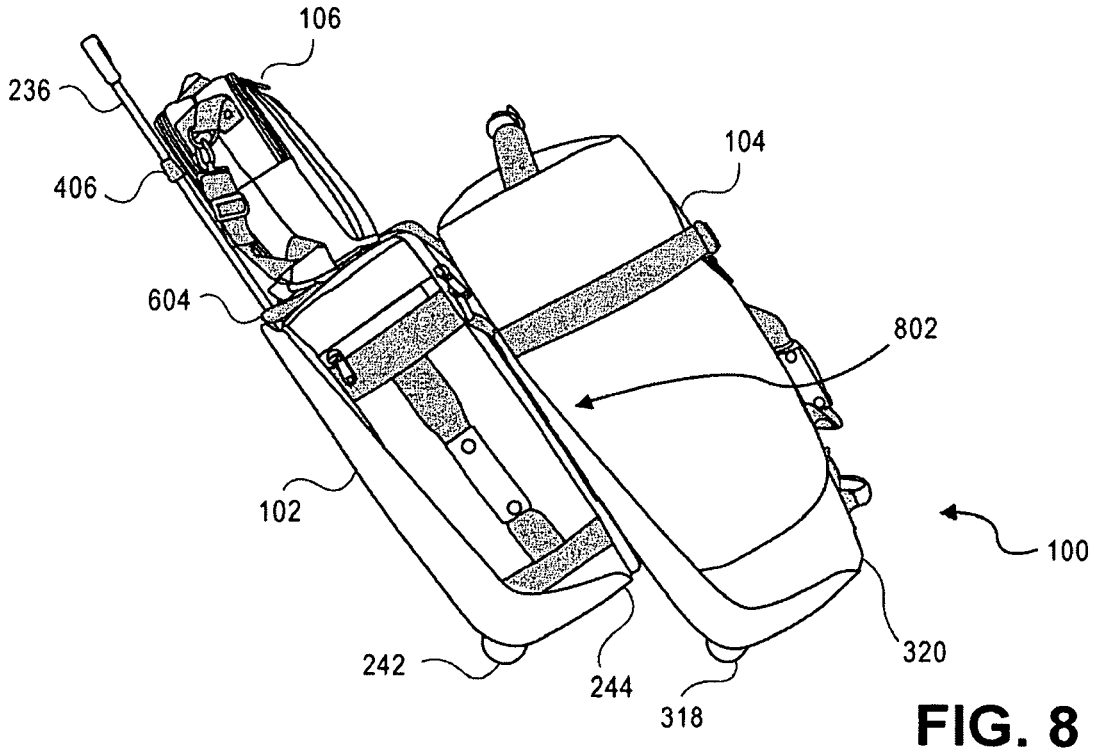

When first bag 102 and second bag 104 are tilted or inclined as shown in FIG. 8, most of the weight of second bag 104 sits in front of wheels 318. Consequently, the weight of second bag 104 keeps second bag 104 firmly pressed against first bag 102, and prevents second bag 104 from accidentally reverting to the upright position. Furthermore, a sufficient portion of the weight of the assembly 100 typically rests in front of wheels 242 to prevent first bag 102 from reverting to the upright position. As described in greater detail below, this tendency for the bags to stay in inclined or pitched forward positions may be referred to as internal pitch stability or self-stabilizing.

In one embodiment, the contact area where the front 222 of first bag 102 contacts the back 302 of second bag 104 covers more than seventy-five percent of the front 224 of first bag 102 and more than sixty percent of the back 302 of second bag 104. This contact area helps to keep second bag 104 from shifting relative to first bag 102.

Accordingly, when the bags 102, 104 are substantially fully loaded and are configured in the position depicted in FIG. 8, luggage assembly 100 tends to remain in that position, with some of the weight of the assembly supported by wheels 242, and the rest supported by wheels 318. Consequently, once the assembly has been completed, the traveler need not expend any effort to keep the assembly together and properly positioned. The traveler may also easily move assembly 100 with a single hand. Furthermore, whether stationary or in motion, and whether tilted or not, the assembly 100 is completely self-stabilized and may continue on its established course with no hands or other external support.

In addition, in some embodiments, when in the completed and ready-to-roll position depicted in FIG. 8, much of the weight of assembly 100 can rest in front of wheels 242. For instance, depending upon the weight of each bag, and the distribution of weight in each bag, approximately twenty to forty percent of the weight of the assembly 100 might rest in front of the wheels 242 of the first bag 102.

Furthermore, handle 236 provides significant leverage, and reinforcement handle strap 604 prevents second bag 104 from shifting from its position on first bag 102. Consequently, it is typically easy to press down on handle 236 and lift wheels 318 completely off of the ground. For example, if the weight is well distributed within the bags, it may be easy for a 100 pound traveler to perform this operation with one hand on a luggage assembly 100 weighing in excess of 100 pounds. Additionally, the further down the traveler pushes handle 236, the more weight shifts in front of wheels 242. The traveler may therefore easily balance the whole assembly 100 on wheels 242 similar to maneuvering baby strollers over steps, escalators, etc. Accordingly, with the assembly 100 balanced on the wheels 242 of the leading bag 102, the traveler may find it very easy to maneuver the entire assembly 100 around turns, over steps, up and down escalators, and through various other obstacles which would be more difficult to handle with two or more pieces of conventional luggage, one in each hand. Further, since assembly 100 is no wider than the widest bag in the assembly 100, it may be easy to maneuver assembly 100 through crowded or narrow openings or passages.

When the traveler does not want assembly 100 to move, the traveler may simply return first bag 102 to the upright position, so that feet 244 contact the ground and bear some of the weight of assembly 100.

Also, as indicated above, the way reinforcement handle strap 604 connects the first and second bags together helps to keep the left and right sides of second bag 104 from lifting or moving away from first bag 102 when assembly 100 is in the rollable configuration. In other words, reinforcement handle strap 604 prevents second bag 104 from spinning or rotating along its longitudinal axis, relative to first bag 102. For example, in the embodiment of FIG. 8, reinforcement handle strap 604 prevents second bag 104 from rolling more than five degrees, relative to first bag 102, when first bag 102 and second bag 104 are substantially fully packed. Another embodiment may allow the first bag to roll up to thirty degrees, relative to the first bag. This type of stability for assembly 100 may be referred to as internal roll stability. By contrast, the resistance of the entire assembly 100 from rotating about its longitudinal axis may be determined largely by the distance between the wheels on the bottom of first bag 102, and that type of stability may be referred to as external roll stability.

Assembly 100 also exhibits good internal and external pitch stability. For purposes of this disclosure, internal pitch stability refers to the tendency of both bags 102, 104 to retain the same angle of inclination, relative to each other, when the first and second bags 102, 104 are in the rollable configuration. In other words, the attachment members, the weight distribution, and other features work to resist forces which might otherwise cause one bag to lean up or down, relative to the other bag, even when a traveler is not holding onto handle 236 or any other part of the first bag 102 or second bag 104. Good internal pitch stability is one of the attributes that makes it easy to lift wheels 318 by pressing down on handle 236. External pitch stability refers to the tendency of the complete assembly 100 to keep all four wheels 242, 318 on the ground.

Furthermore, assembly 100 exhibits good internal and external yaw stability. For purposes of this disclosure, internal yaw stability refers to the tendency for the first and second bags 102, 104 to keep the same relative alignment for their longitudinal axes. In other words, considering the contact patch 802 between the first and second bags 102, 104, the front 304 of the second bag 104 tends not to rotate relative to the back 222 of the first bag 102. External yaw stability refers to the tendency for assembly 100 to track straight when it is rolling on all four wheels. The characteristics of pitch, roll, and yaw stability exhibited by assembly 100 contribute to assembly 100 being self-stabilized when in motion and when stationary, whether bags 102, 104 are tilted or not. Note that components of assembly 100 can be coupled using alternative attachment means such as one or more Velcro straps, straps with snaps or zippers, and straps on the trailing bag 104 that disconnect and reconnect with corresponding straps on the leading bag 102. The straps may or may not be adjustable to provide suitable balance/leverage for bags packed with different weights, and that may serve as reinforcement straps when not being used to form a luggage assembly 100.

Figure 10:
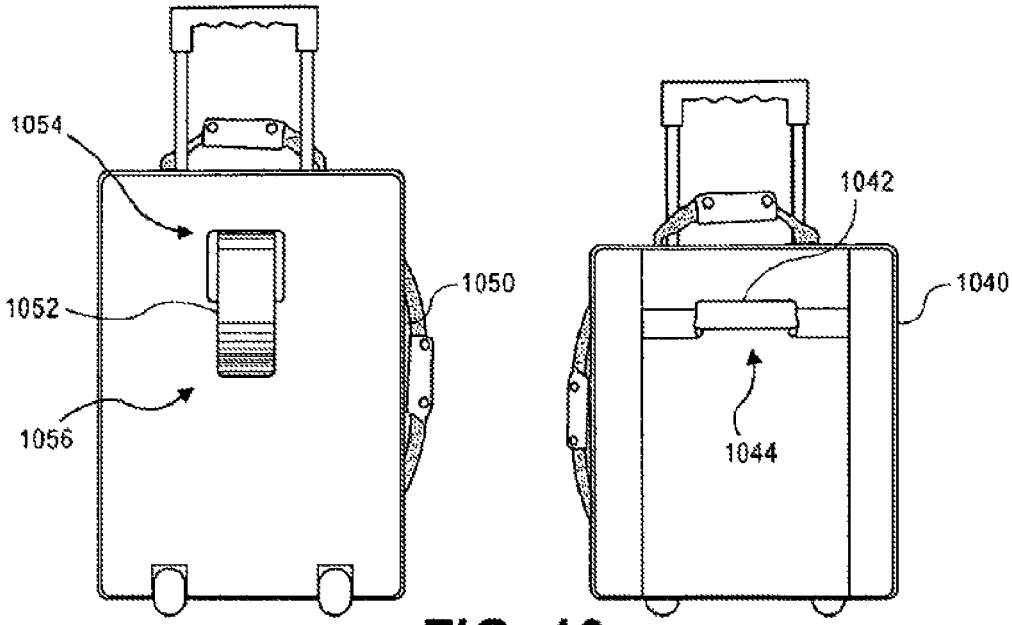
FIG. 10 depicts a rear view of a carry-on bag and a front view of a rolling duffel bag, according to another embodiment of the present invention.

FIG. 10 depicts a rear view of another embodiment of carry-on bag 1040 and a front view of another embodiment of rolling duffel bag 1050. Carry-on bag 1040 may also be referred to as a leading bag or a first bag 1040. Rolling duffel bag 1050 may also be referred to as a trailing bag or a second bag 1050. As shown, a mating strap 1042 is affixed to the front of first bag 1040, and a corresponding mating hook 1052 is attached to the back of second bag 1050. Mating strap 1042 may be made of textile, leather, plastic, or any other suitable material. Mating hook 1052 may be made of metal, plastic, or any other suitable material.

Mating strap 1042 is dimensioned to receive mating hook 1052. For instance, the top 1054 of mating hook 1052 may be approximately 4 inches wide, and the opening 1044 between mating strap 1042 and the back of first bag 1040 may be substantially the same width as top 1054. The relatively wide mating hook 1052, when engaged by mating strap 1042 may tend to prevent the left and right sides of second bag 1050 from moving or lifting away from first bag 1040. Opening 1044 may also be referred to as a mating slot 1044. Other dimensions may be used in other embodiments.

Figure 11:
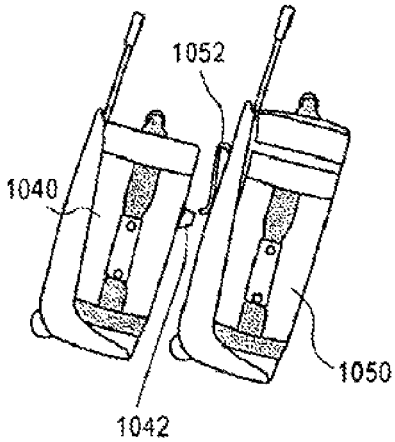
FIGS. 11-13 show side views of the carry-on and rolling duffel bags of FIG. 10, in different stages of another example embodiment of a method for creating a luggage train.

FIG. 11 depicts a side view of bags 1040 and 1050 in a first position. To begin connecting first bag 1040 and second bag 1050 into a stable luggage assembly 1000 (FIGS. 12 and 13) or luggage train, the traveler may lean first bag 1040 and second bag 1050 slightly backwards, as shown. The traveler may then insert the tip 1056 of mating hook 1052 into mating slot 1044.

Figure 12:
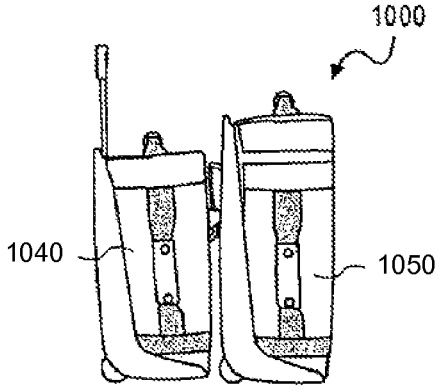

FIG. 12 depicts a side view of bags 1040 and 1050 upright in luggage assembly 1000. As depicted, when first bag 1040 and second bag 1050 are returned to upright positions, mating hook 1052 may keep the bags together. Accordingly, mating hook 1052 and mating strap 1042 may be referred to as attachment members.

Figure 13:
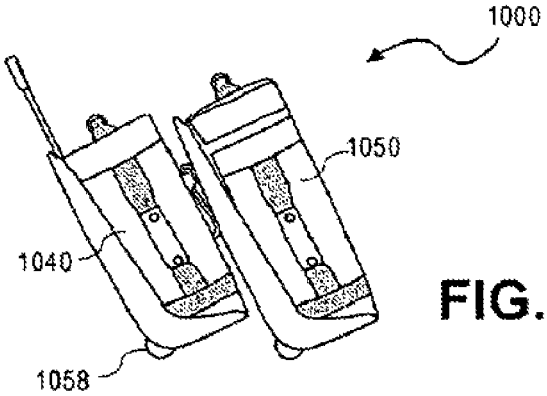
Figure 14:
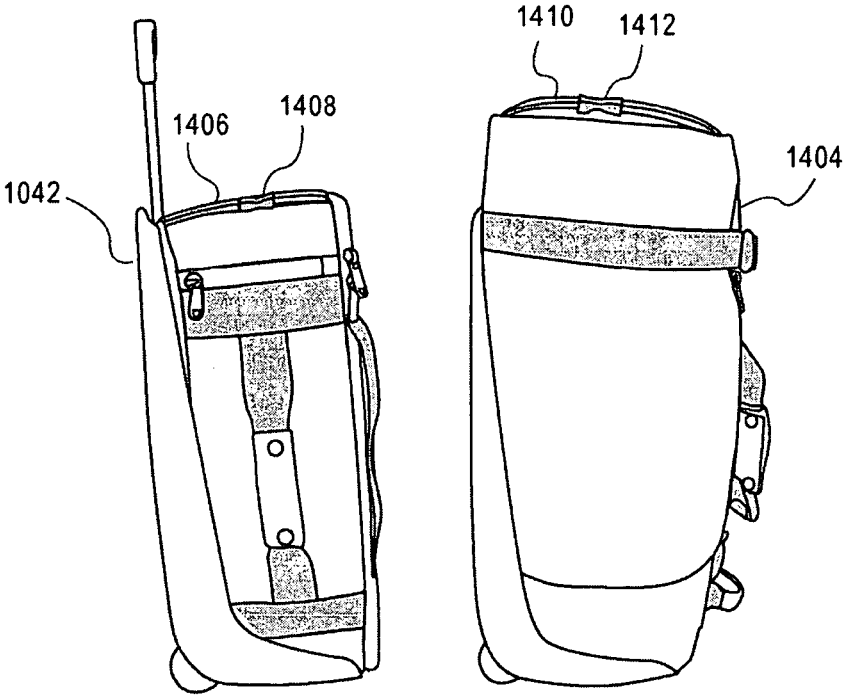
FIGS. 14-17 show side views of another embodiment of carry-on and rolling duffel in different stages of another method for creating a luggage train.

FIG. 13 depicts a side view of bags 1040 and 1050 tilted in a luggage assembly 1000. As first bag 1040 is tilted away from second bag 1050, mating hook 1052 slides down into mating slot 1044 until the inside top 1054 of mating hook 1052 engages mating strap 1042. In a tilted orientation, at least some the weight of second bag 1050 may rest in front of the wheels 1058 of second bag 1050, so that gravity presses the back of second bag 1050 against the front of first bag 1040. Consequently, similar to the embodiment of FIG. 8, the luggage assembly 1000 may be self-stabilized in this configuration, and may be easily rolled with one hand. The handle of first bag 1040 may also be used to lift wheels 1058 off of the ground, thereby allowing for good maneuverability, substantially as described above with regard to FIGS. 2-9.

FIGS. 14-17 show side views of another embodiment of carry-on bag 1402 and rolling duffel bag 1404 in different stages of another method for creating a luggage assembly 1400. In the embodiment shown, carry-on bag 1402 and rolling duffel bag 1404 include two or more respective sets of straps 1406, 1410 with releasable connectors 1408, 1412 coupled at an intermediate portion along straps 1406, 1410. Connectors 1408, 1412 are configured to be released and recoupled to a receiving connector portion either on the same bag or on the adjacent bag. That is, one end of straps 1406, 1410 are attached to the top back of bags 1402, 1404 and an intermediate end of straps 1406, 1410 terminates with a portion of connector 1408, 1412. Another end of straps 1406, 1410 are attached to the front top of bags 1402, 1404 and another intermediate end of straps 1406, 1410 terminates with another portion of connector 1408, 1412. Straps 1406, 1410 can span from front to back across the tops of respective bags 1402, 1404 when portions of connectors 1408, 1412 are coupled. Additionally, portions of connectors 1412 on duffel bag 1404 can couple to a compatible portion of connector 1408 on carry-on bag 1402 and vice versa. Straps 1406, 1410 and connectors 1408, 1412 may also be referred to collectively herein as attachment members.

Figure 15:
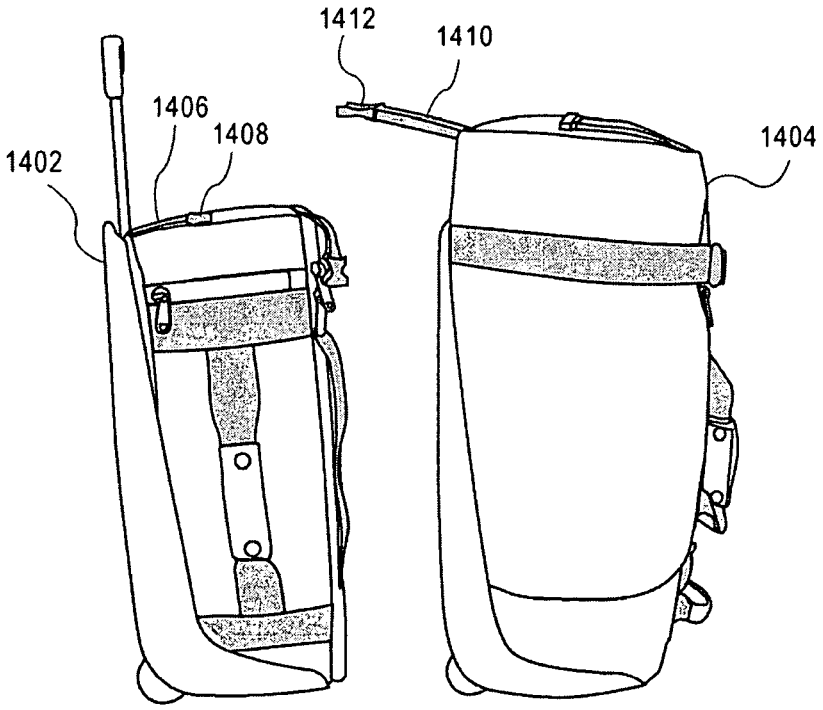
Figure 16:
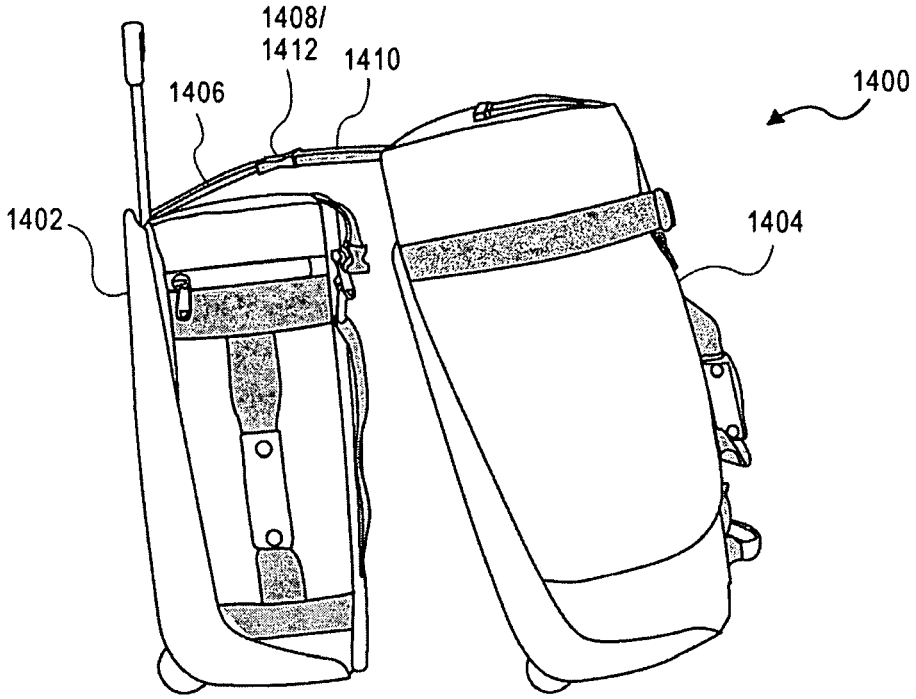

FIG. 15 shows connectors 1408, 1412 decoupled, leaving four intermediate ends of straps 1406, 1410 loose. In FIG. 16, the portions of connectors 1412 on straps 1410 attached to the top back of duffel bag 1404 are coupled to portions of connectors 1408 on straps 1406 that are attached to the top back of the carry-on bag 1402. The length of straps 1406, 1410 may be adjusted to draw carry-on bag 1402 and duffel bag 1404 closer together once the connectors 1408/1412 are coupled.

Figure 17:
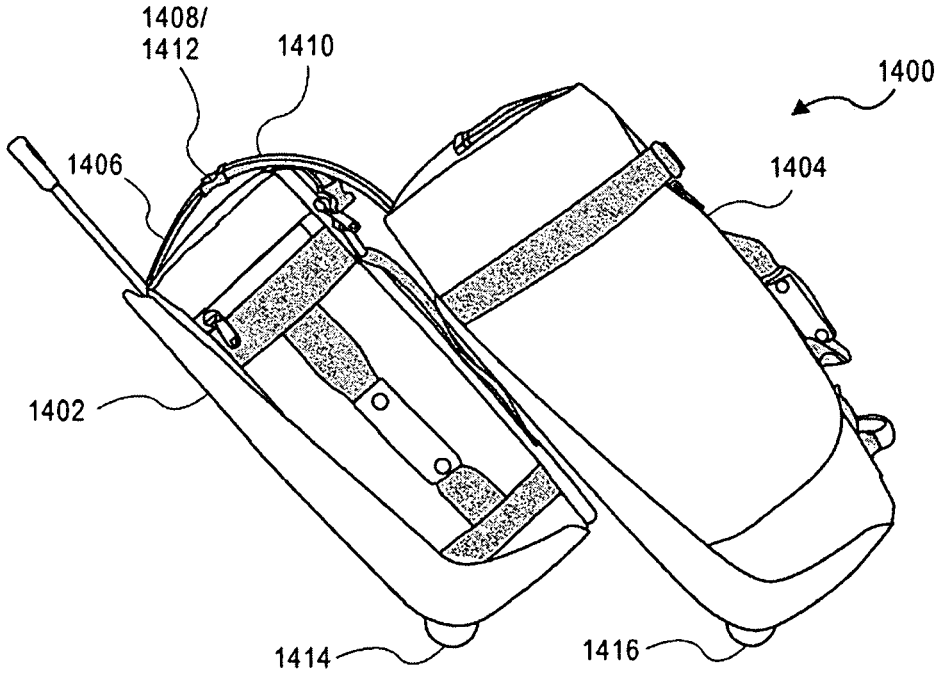
Figure 18:
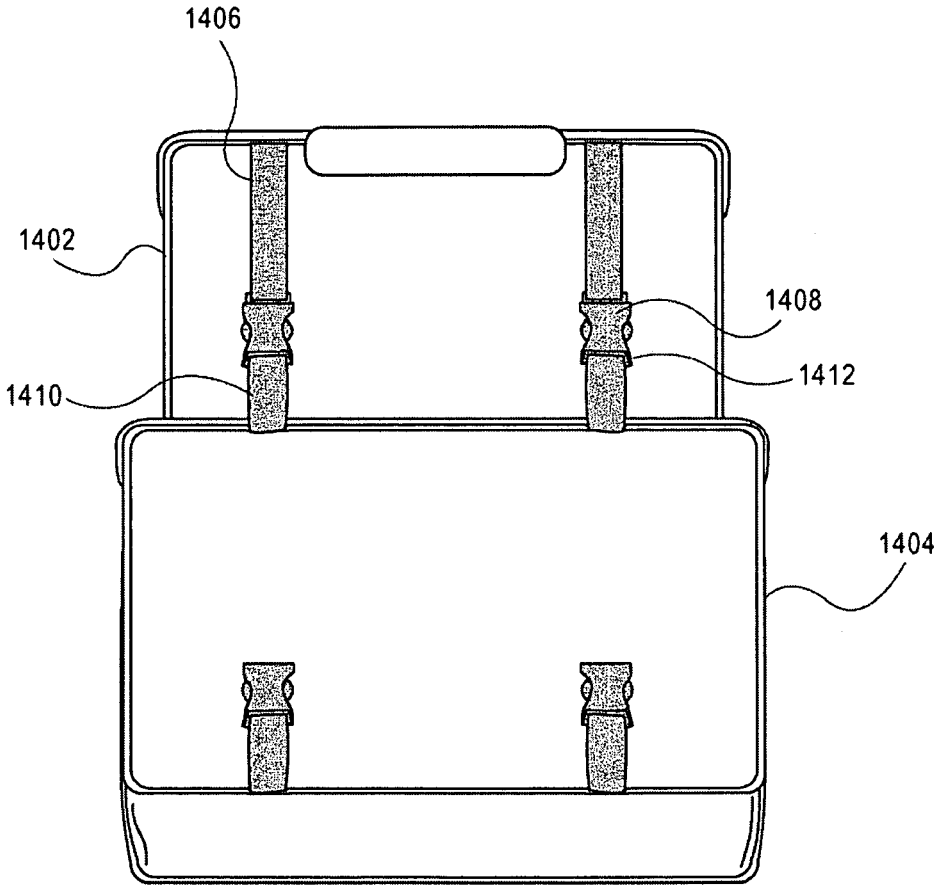
FIG. 18 shows a top view of the carry-on coupled to the rolling duffel in FIG. 17.

FIG. 17 shows a side view of luggage assembly 1400 with bags 1402, 1404 in a tilted position. With connectors 1408, 1412 coupled, bag 1404 leans in the direction of bag 1402 as bag 1402 is tilted. In this orientation, at least some the weight of bag 1404 may rest over and/or in front of the wheels 1414 of bag 1402, so that gravity presses the back of bag 1404 against the front of bag 1402. Consequently, similar to the embodiment of FIG. 8, the luggage assembly 1400 may be self-stabilized in this configuration, and may be easily rolled with one hand. The handle of first bag 1402 may also be used to lift wheels 1416 off of the ground, thereby allowing for good maneuverability, substantially as described above with regard to FIGS. 2-9.

Thus, as has been described, embodiments of a rollable luggage assembly may be made of two or more luggage pieces using suitable attachment means to keep the luggage assembly self-stabilized when stationary and when rolling. The size and weight of each luggage piece, when fully loaded, as well as the configuration of the attachment means, may serve to keep the pieces balanced on the wheels of the assembly, In light of the principles and example embodiments described and illustrated herein, it will be recognized that the illustrated embodiments can be modified in arrangement and detail without departing from such principles. For instance, alternative embodiments may use approaches like those described above to create luggage assemblies with other types and sizes of bags, other types of attachment members, etc. For instance, the trailing bag may be shaped substantially like a rectangular cuboid in some embodiments. Also, second trailing bag may be attached to the first trailing bag to form a rolling luggage assembly with six wheels on the ground. Likewise, more than two trailing bags could be used.

Also, the foregoing discussion has focused on particular embodiments, but other configurations are contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments.

Similarly, although example processes have been described with regard to particular operations performed in a particular sequence, numerous modifications could be applied to those processes to derive numerous alternative embodiments of the present invention. For example, alternative embodiments may include processes that use fewer than all of the disclosed operations, processes that use additional operations, and processes in which the individual operations disclosed herein are combined, subdivided, rearranged, or otherwise altered.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims and all equivalents to such implementations.

What is claimed is:

1. A luggage assembly comprising:

a first piece of luggage, having a first height, the first piece of luggage comprising:

a handle configured to extend above a top portion of the first piece of luggage, to facilitate pulling the luggage assembly; and two or more wheels at the bottom of the first piece of luggage, the two or more wheels permitting the first piece of luggage to roll when the handle is pulled;

a second piece of luggage comprising:

a second luggage body having a second height, greater than the first height;

two or more wheels at the a bottom of the second piece of luggage permitting the first piece of luggage to roll when the handle is pulled;

an attachment member configured to removably connect the first piece of luggage to the second piece of luggage to form a self-stabilizing luggage assembly in which the second piece of luggage tilts to contact the first piece of luggage, and remains tilted and in contact with the first piece of luggage regardless of whether the first piece of luggage is in a tilted or upright orientation and whether the luggage assembly is stationary or in motion.

2. A luggage assembly according to claim 1, further comprising:

the attachment member couples to the handle.

3. A luggage assembly according to claim 1, further comprising:

the attachment member comprises an attachment strap affixed to the second piece of luggage and configured to be wrapped around the handle.

4. A luggage assembly according to claim 3, further comprising:

the second piece of luggage comprises a longitudinal center between a left side of the second piece of luggage and a right side of the second piece of luggage; and the attachment strap includes two ends, one end of the two ends is affixed at a point spaced between the left side and the longitudinal center and the other end of the two ends is affixed at a point spaced between the right side and the longitudinal center.

5. A luggage assembly according to claim 4, wherein the attachment strap is affixed to a back side of the second piece of luggage.

6. A luggage assembly according to claim 3, wherein the attachment strap comprises:

a left segment and a right segment, each extending from the second piece of luggage to the handle of the first piece of luggage; and an intermediate segment connecting the left and right segments and extending across the handle.

7. A luggage assembly according to claim 3, further comprising:

the handle is a rigid extendable handle and the attachment strap is flexible.

8. A luggage assembly according to claim 1, wherein a percentage of the weight of the second piece of luggage is at or behind at least one wheel of the two or more wheels at the bottom of the first piece of luggage when the first and second pieces of luggage are inclined in a rolling configuration.

9. A luggage assembly according to claim 1, wherein the handle is substantially rigid and provides leverage for inclining the first and second pieces of luggage.

10. A luggage assembly according to claim 1, the attachment member is dimensioned to engage the first piece of luggage in a manner that prevents the second piece of luggage from moving away from the first piece of luggage when the first and second pieces of luggage are inclined.

11. A luggage assembly according to claim 1, further comprising the second piece of luggage has a weight, a portion of which rests in back of at least one wheel of the at least two wheels on the second piece of luggage, thereby tending to cause the second piece of luggage to press against the first piece of luggage.

12. A luggage assembly according to claim 1, further comprising:

at least one of the group consisting of:

a mating strap on a front of the first piece of luggage, the attachment member comprising a mating hook to engage the mating strap; and a first set of straps with connector portions on the first piece of luggage, the attachment member comprising a second set of straps with connector portions on the second piece of luggage to engage the connector portions on the first set of straps.

13. A method for forming a self-stabilized luggage train, the method comprising:

standing a first piece of luggage upright on a supporting surface, wherein the first piece of luggage comprises a first body and two or more wheels;

positioning a second piece of luggage on the supporting surface and leaning against the first piece of luggage, wherein the second piece of luggage comprises a second body, two or more wheels, and an attachment member connected to the second body;

connecting the attachment member to the first piece of luggage to form the self-stabilized luggage train, the attachment member connected in a manner that will substantially prevent the second piece of luggage from moving away from the first piece of luggage when the first and second pieces are inclined, the luggage train remaining self-stabilized while the first piece of luggage is upright and inclined, and while the luggage train is in motion and stationary; and wherein to form the self-stabilized luggage train, the self-stabilized luggage train having a weight which is substantially supported by at least two of the wheels on the first piece of luggage and at least two of the wheels on the second piece of luggage.

14. A method according to claim 13, wherein connecting the attachment member to the first piece of luggage to form the self-stabilized luggage train further comprises at least one of the group consisting of:

wrapping the attachment member around at a handle located at a top of the first piece of luggage;

engaging the attachment member with a mating strap on the body of the first piece of luggage, wherein the attachment member comprises a mating hook; and engaging the attachment member with a first set of straps with first connector portions on the first piece of luggage, the attachment member comprising a second set of straps with second connector portions on the second piece of luggage that engage the first connector portions.

* * * * *